United States Patent [19]

Price, Jr. et al.

[11] 4,456,202

[45] Jun. 26, 1984

[54] BURST HEIGHT COMPENSATION

[75] Inventors: Donald A. Price, Jr., Palo Alto; Charles A. Louis, III, San Jose, both of Calif.

[73] Assignee: The United States of America as represented by the Secretary of the Navy, Washington, D.C.

[21] Appl. No.: 418,895

[22] Filed: Sep. 16, 1982

[51] Int. Cl.[3] ..... F41G 7/00; F42B 15/02

[52] U.S. Cl. ..... 244/3.15

[58] Field of Search ..... 102/200, 211, 214; 244/3.15, 3.19; 89/1 A

[56] References Cited

U.S. PATENT DOCUMENTS 3,784,800 1/1974 Willoteaux ..... 244/3.15

3,990,657 11/1976 Schott ..... 244/3.15

*Primary Examiner*—Charles T. Jordan

*Attorney, Agent, or Firm*—R. F. Beers; C. D. B. Curry; W. C. Daubenspeck

[57] ABSTRACT

A method of increasing the predictable effectiveness of a ballistic reentry body having a predicted nominal reentry trajectory. Beginning at reentry or another predetermined location, the distance travelled by said reentry body is calculated based on measured longitudinal acceleration and preset predicted trajectory parameters. When the reentry body reaches a predetermined altitude as measured by an onboard radar, the calculated distance travelled to the altitude is compared with the predicted nominal distance travelled to the altitude to determine the actual trajectory of the reentry body. Based on this actual trajectory, the actual distance travelled from reentry to a preferred fuzing location is determined. When the calculated distance travelled equals the distance required to reach the preferred fuzing location, the fuze signal is sent to the fire set and then to the warhead.

4 Claims, 2 Drawing Figures

BURST HEIGHT COMPENSATION

BACKGROUND OF THE INVENTION

1. Field of the Invention

This invention relates in general to compensating for errors in the trajectory of ballistic reentry bodies and, in particular, to a method of compensating for such errors by adjusting the fuzing location.

2. Description of Prior Art

It is well known that the theoretical trajectory of ballistic missiles can be predetermined with great accuracy. Consequently, the so-called "nominal" position of the missile at any time in flight can be predicted. However, because of errors generated by the weapon delivery system, the standard deviation of the weapon system delivery dispersion at nominal reentry time is described by an inclined ellipsoid in the trajectory plane. Conventional fuzing subsystems utilize combinations of impact fuzing, fuzing at a radar measured altitude, and fuzing at a predetermined time after encountering a given longitudinal deceleration level. With these fuzing techniques, the dispersion ellipsoid is propogated along the trajectory to yield an elongated downrange-cross-range ellipse at the fuzing location. The downrange dispersion caused by errors generated in the weapon delivery system limits the predictable effectiveness of the ballistic reentry body upon the target.

One approach for reducing the downrange errors generated in the delivery system is described in the U.S. Pat. No. 3,990,657. In this approach, the downrange error is reduced by determining the altitude error from the nominal at a particular time during flight, computing a position error from this altitude error, and then maneuvering the reentry body in flight to return the reentry body to its nominal trajectory. A major disadvantage of this method is, of course, that means must be provided for manuevering the reentry body to change the ballistic trajectory.

SUMMARY OF THE INVENTION

It is an object of the present invention to increase the predictable effectiveness of the reentry body upon the intended target.

Another object of the present invention is to compensate for errors generated in the weapon delivery system.

Another object of the present invention is to reduce the downrange position error at fuzing to increase the effectiveness of the missile upon the target.

These and other objects are provided by an approach which detects position deviation from the nominal trajectory by in-flight measurements and changes the fuzing location to compensate for the error in trajectory. According to the preferred embodiment of the present invention, the compensation process for the error in reentry body trajectory is initiated at reentry. Beginning at reentry, the actual path length of the reentry body is measured based on measured longitudinal acceleration and preset predicted trajectory parameters. When the reentry body reaches a predetermined altitude as measured by an onboard radar, the measured path length from reentry to the predetermined altitude is compared with the predicted nominal path length from reentry to the predetermined altitude to determine the actual trajectory of the reentry body. Based on this actual trajectory, the actual path length from reentry to the optimum fuzing location is calculated. When the measured path length to fuzing equals the calculated path length to fuzing, the fuze signal is sent to the fire set.

Other objects, advantages, and features of the present invention will become apparent from the following detailed description of the invention when considered in conjunction with the accompanying drawings wherein:

DESCRIPTION OF THE PREFERRED EMBODIMENT

Figure 1:
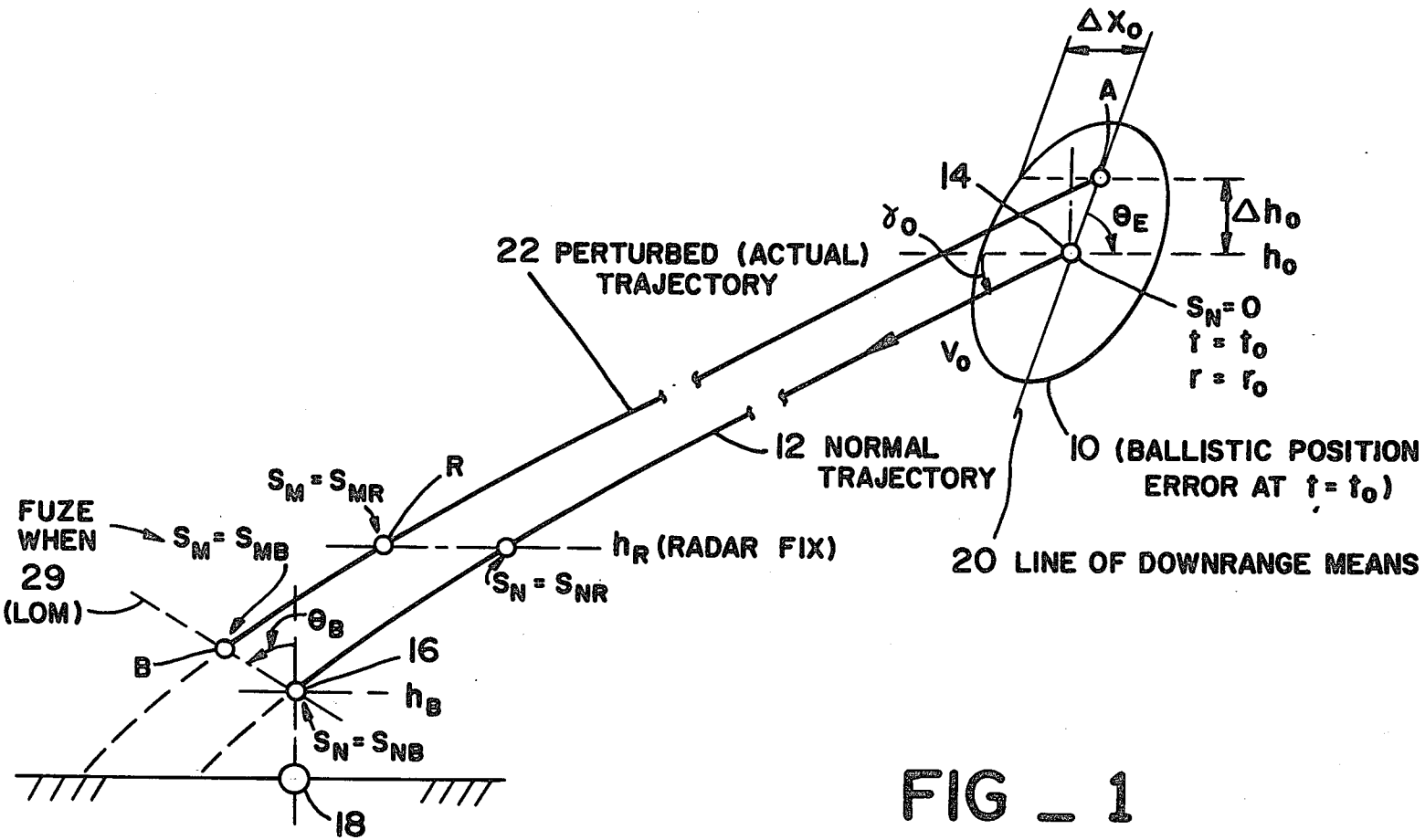
FIG. 1 illustrates the basic burst height compensation technique of the present invention.

Referring now to the drawings and, in particular to FIG. 1, the inclined ellipsoid 10 represents the weapon system delivery error distribution at reentry into the atmosphere (e.g. approximately 400,000 feet altitude) with the nominal trajectory represented by line 12 from the nominal reentry location 14 to the nominal burst location 16 at altitude $h_B$ above a target 18. The nominal trajectory is defined at reentry by an initial velocity $V_o$ along an initial path angle $\gamma_o$ with respect to the horizontal.

The delivery error is assumed to be along the line of downrange means (LOM) 20 which is defined by the locus of the midpoint of the downrange dispersion ($\Delta X_o$) at each altitude slice ($\Delta h_o$) through the inclined ellipse 10. The LOM 20 is represented by a line through the center of the error ellipse 10 inclined at an angle $\theta_E$ with the horizontal.

It is of critical importance to accurately determine when the reentry body reaches the nominal reentry location 14. If the missile guidance is based on a constant time of flight, a predictable constant time of flight is available for use in determining when reentry occurs. If guidance options other than constant time of flight are used, a guidance update is necessary to define the nominal trajectory. Assuming a predictable constant time of flight to the predicted error ellipse 10, a representative actual trajectory 22 will intersect the LOM 20 at some location A at a time of $t_o$ where $t_o$ is the predicted constant time of flight to reentry. The predicted reentry time $t_o$ will typically run from a predetermined time after the start of missile guidance to the time of reentry.

Figure 2:
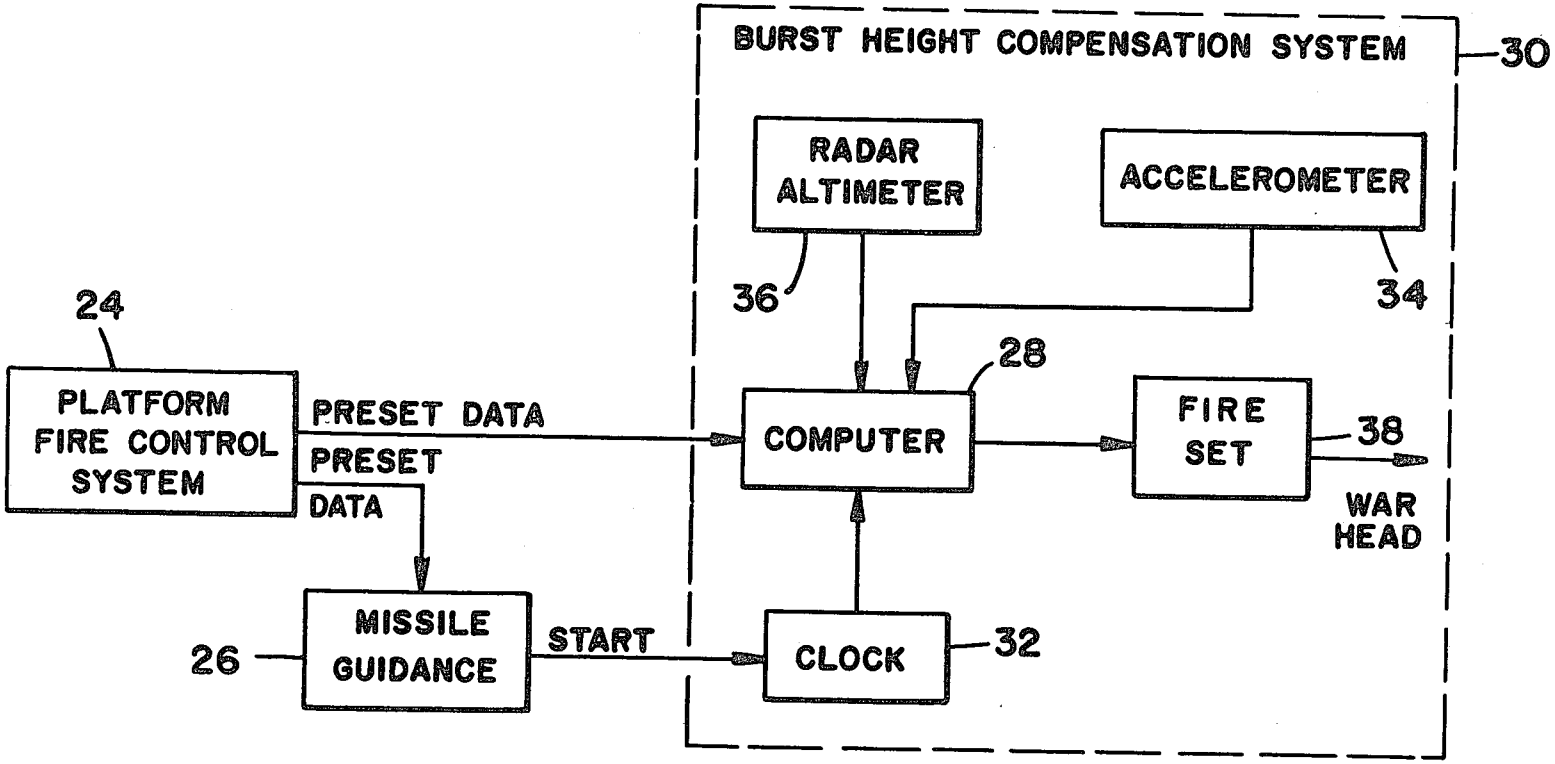
FIG. 2 is a block diagram illustrating the signal flow in the present invention.

Referring now to both FIG. 1 and to the block diagram of FIG. 2 which illustrates the signal flow in a system according to the present invention, prior to launch of the missile, the fire control system 24 of the launch platform provides preset inputs to the missile guidance system 26 and a computer 28 in the burst height compensation system 30 on board the reentry body. These preset inputs define the nominal trajectory of the reentry body and the predicted weapon system delivery error. In a preferred implementation of the present invention, the preset data provided to the computer 28 includes the reentry time $t_o$ and nominal trajectory parameters including the initial reentry velocity $V_o$, the initial reentry path angle $\gamma_o$, the nominal path length from reentry to a specific altitude $S_{NR}$, and the nominal path length from reentry to the burst locations $S_{NB}$. The preset data to the computer 28 also includes the angle of inclination $\theta_E$ of the line of downrange means 20 and an angle of inclination $\theta_B$ of a line-of-means 29 at the fuzing location which is selected to optimize the burst location for the actual trajectory.

During the missile first or second stage burn, the burst height compensation system 30 is activated and the missile guidance system 26 sends a signal to start a flight clock 32 in the burst height compensation system at a predetermined time from guidance start.

Following deployment of the reentry body, reentry occurs when t equals $t_o$ in clock 32 and at the representative location A. At t equals $t_o$, the burst height compensation system 30 begins on-board computations which measure the actual path length of the reentry body after reentry. Based on the measured longitudinal acceleration from an accelerometer 34 and the preset inputs from the platform fire control system 24, the computer 28 calculates the actual trajectory according to the following equations:

$$V=V_o+\int(a_x-g\sin\gamma)dt \quad (1)$$

$$\gamma=\gamma_o+\int g/V\,(1-V^2/gr)\cos\gamma dt \quad (2)$$

$$r=r_o+\int V\sin\gamma dt \quad (3)$$

$$g=g_o r_o^2/r^2 \quad (4)$$

$$S_M=\int V\,dt \quad (5)$$

$$S_{MB}=S_{NB}+(S_{MR}-S_{NR})\,K_\theta \quad (6)$$

$$K_\theta=f(\gamma_o,\ \theta_E,\ \theta_B,\ V_o,\ \text{etc.}) \quad (7)$$

where

V is the velocity of reentry body, $\gamma$ is the path angle of the reentry body, $a_x$ is the measured longitudinal acceleration of the reentry body, g is the calculated acceleration of gravity, r is the distance of the reentry body from the center of the earth, $S_M$ is the measured path length from $t_o$, $S_{MB}$ is the measured path length from $t_o$ to the desired burst height, and $K_\theta$ is a gain factor chosen to provide the optimum fuzing location.

At t equals $t_o$, the computer 28 begins integration according to equations (1)–(7) to provide the reentry body path length $S_M$. When the reentry body reaches the radar fix altitude $h_R$ as measured by an onboard radar altimeter 36, the computer 28 compares the calculated path length ($S_M=S_{MR}$) to the radar fix altitude with the nominal (preset) path length $S_{NR}$ to the radar fix altitude. Using this comparison, the computer, based on the predetermined gain factor $K_\theta$, computes (equation (6)) the distance $S_{MB}$ from representative location A to the desired fuzing location. When $S_M$ equals $S_{MB}$, the fuze signal is sent to the fire set 38.

Although in FIG. 1, the fuzing location is shown as lying on the line-of-means 29, it is noted that the fuzing location as determined by equation (7) may be located at any point on the flight path 22 after the radar fix altitude to provide optimum burst location.

A person skilled in the art will recognize that the equations presented in the specification are merely illustrative and that the scope of the present inventon embraces the use of numerous other algorithms in implementing the present invention.

It can be seen that the present invention provides the ability to partially compensate for some of the errors generated by the weapon delivery system and also for some of the errors induced during the vehicle's passage through the atmosphere such as those due to winds in the plane of the trajectory, density variations in the atmosphere from the assumed density, and variations in the drag and lift from the assumed nominal reentry body performance.

Obviously many modifications and variations of the present invention are possible in the light of the above teachings. It is therefore to be understood that within the scope of the appended claims the invention may be practiced otherwise than as specifically described. For example, a radar altimeter could be used to measure altitude at a specified time in order to determine the path length traveled from represntative location A to the alternate radar fix. Then the same distance from point A to the fuze point B would be calculated by a different but similar algorithm shown in equation (6).

We claim:

1. A method of increasing the predictable effectiveness of a ballistic reentry body having a predicted nominal reentry trajectory, which comprises the steps of:

(a) determining when said reentry body reaches a predetermined location on its nominal trajectory;

(b) continually determining the distance travelled by said reentry body after said reentry body reaches said predetermined location;

(c) periodically measuring the altitude of said reentry body to determine when said reentry body reaches a predetermined altitude;

(d) determining an assumed actual trajectory by comparing the determined distance travelled to the predetermined altitude by said reentry body with the nominal distance travelled to said predetermined altitude by said reentry body from predetermined location on the nominal trajectory;

(e) calculating the distance as determined in step (b) to a selected burst location for the assumed actual trajectory; and (f) fuzing said reentry body when the determined distance travelled after the predetermined location equals the calculated distance.

2. The method as recited in claim 1 wherein the step of determining when said reentry body reaches a predetermined location on its nominal trajectory comprises the step of determining when said reentry body reenters the atmosphere.

3. A method as recited in claim 1 wherein the step of continually determining the distance travelled by said reentry body after the reentry body reaches the predetermined location comprises:

(a) continually measuring the longitudinal acceleration of said reentry body;

(b) continually calculating the present velocity of the reentry body from said measured acceleration and preset predicted parameters including the velocity of said reentry body at said predetermined location and the acceleration of gravity acting on said reentry body; and (c) continually calculating the distance travelled by said reentry body from said predetermined location from said calculated velocity.

4. A method as recited in claim 1 wherein the step of continually determining the distance travelled by said reentry body after the reentry body reenters the atmosphere comprises:

(a) continually measuring the longitudinal acceleration of said reentry body;

(b) continually calculating the present velocity of the reentry body from said measured acceleration and preset predicted parameters including the velocity of said reentry body when said reentry body reenters the atmosphere and the acceleration of gravity acting on said reentry body; and (c) continually calculating the distance travelled by said reentry body after reentry into the atmosphere from said calculated velocity.

* * * * *